US011503967B1

(12) United States Patent
Noutsis

(10) Patent No.: US 11,503,967 B1
(45) Date of Patent: Nov. 22, 2022

(54) FREE-STANDING PAPER TOWEL DISPENSER

(71) Applicant: Photios Noutsis, Farmingville, NY (US)

(72) Inventor: Photios Noutsis, Farmingville, NY (US)

( * ) Notice: Subject to any disclaimer, the term of this patent is extended or adjusted under 35 U.S.C. 154(b) by 0 days.

(21) Appl. No.: 17/591,981

(22) Filed: Feb. 3, 2022

Related U.S. Application Data

(60) Provisional application No. 63/278,757, filed on Nov. 12, 2021.

(51) Int. Cl.
*A47K 10/38* (2006.01)
*A47K 5/12* (2006.01)
*A47K 10/32* (2006.01)

(52) U.S. Cl.
CPC ..... *A47K 10/3836* (2013.01); *A47K 5/1211* (2013.01); *A47K 10/32* (2013.01); *A47K 2010/3233* (2013.01); *A47K 2210/00* (2013.01)

(58) Field of Classification Search
CPC .. A47K 10/3836; A47K 10/32; A47K 5/1211; A47K 2010/3233; A47K 2210/00
USPC ..... 222/192; 34/90
See application file for complete search history.

(56) References Cited

U.S. PATENT DOCUMENTS 1,825,822 A * 10/1931 Rundell ..... A47K 10/3836 242/571.5
2,661,165 A * 12/1953 Salmonson ..... A47K 10/3836 242/597
2,994,488 A * 8/1961 Waddell ..... A47K 10/3836 248/176.1
4,436,224 A * 3/1984 McInerny ..... A47K 10/32 222/181.2
2002/0171003 A1* 11/2002 Johnson ..... B65H 35/10 242/598.5
2008/0011782 A1* 1/2008 Sidman ..... A47K 5/12 222/192
2017/0319019 A1* 11/2017 Simmons ..... A47K 10/3836
2020/0046176 A1* 2/2020 Haralovich ..... A47K 10/22
2021/0307568 A1* 10/2021 Steinke ..... A47K 10/3836

FOREIGN PATENT DOCUMENTS

EP 0687437 B1 * 4/1995
WO WO-2011013014 A3 * 5/2011 ..... A47K 10/421

* cited by examiner

*Primary Examiner* — Stephen M Gravini
(74) *Attorney, Agent, or Firm* — Carter, DeLuca & Farrell LLP; George Likourezos; Bradley J. Shelowitz

(57) ABSTRACT

A paper towel dispenser for use with a paper towel roll includes a base, and a rod supported on the base and extending upwardly from the base at a non-perpendicular angle.

20 Claims, 8 Drawing Sheets

FREE-STANDING PAPER TOWEL DISPENSER

CROSS-REFERENCE TO RELATED APPLICATION

This application claims the benefit of, and priority to, U.S. Provisional Patent Application No. 63/278,757, filed Nov. 12, 2021, the entire contents of which are herein incorporated by reference.

BACKGROUND

Technical Field

This disclosure relates to a dispenser for paper towels and, more particularly, to a free-standing dispenser that provides improved access and functionality for rolls of disposable paper towels and methods of using said dispenser with one hand.

Discussion of Related Art

Disposable paper towels are typically presented as a continuous ream of paper, wrapped around a hollow cardboard tube forming a roll and uniformly segmented by lines of perforation. Dispensers for such rolls of paper towels are most commonly configured to be either vertical, placed for example on a kitchen counter, or to be horizontal, for example mounted under a kitchen cabinet. A horizontal configuration allows gravity to act on the roll, which makes rotation of the roll easier. This ease of use can also sometimes cause an unintended portion of the roll to overextend and become exposed. A vertical configuration provides increased stability and largely prevents over-extending and unintended exposure. However, this increased stability makes rotation of the roll more difficult and can sometimes cause the paper towel to be unevenly torn. Both configurations require two hands for separating a rectangular or square portion from the roll. In the vertical configuration, one hand holds the dispenser placed on a kitchen counter, or holds the roll while the other hand applies a force to the free end of the roll to separate a portion from the roll. In the horizontal configuration, one hand holds the dispenser mounted under a kitchen cabinet, while the other hand applies a force to the free end of the roll to separate a portion from the roll.

Thus, there is a need in the field of paper towel dispensers for an alternate configuration that more evenly balances stability with ease of rotation such that one hand can be used to separate a portion of the roll.

SUMMARY

In accordance with an aspect of the present disclosure, a paper towel dispenser for use with a paper towel roll includes a base and a rod supported on the base. The rod extends upward from the base at a non-perpendicular angle.

In some aspects, the base may be weighted and configured to provide a counterweight to the paper towel.

In some aspects, the base may be made from a dense material.

In some aspects, the base may have a low center of gravity.

In some aspects, the angle between the base and the rod may be approximately 70 degrees.

In some aspects, the rod may be configured to be at least partially inserted into the paper towel roll.

In some aspects, the rod may have a non-circular cross-section and may be configured to inhibit rotation of the paper towel roll relative to the rod.

In some aspects, a stopper may be affixed to the base adjacent to the rod. The stopper may be configured to prevent the paper towel from resting directly against the base.

In some aspects, the rod may define a length that is smaller than a length of a paper towel roll to define a gap between a top end of the rod and an open end of the paper towel roll when the rod is inserted into the paper towel roll. The gap is configured to receive a bottle of cleaning agent.

In some aspects, the rod and stopper may be positioned adjacent a rear edge of the base and along a central longitudinal axis of the base.

In some aspects, the base may act as a stopper configured to create a separation between the paper towel roll and the surface supporting the base.

In some aspects, the paper towel dispenser may include a soap pump affixed to a free end of the rod.

In some aspects, the rod may include a central bore configured to receive a tube coupled to a re-usable container for housing cleaning agents.

In some aspects, the rod may include a central bore configured to directly store a cleaning agent.

In aspects, the rod may have a first end portion attached to a first end portion of the base, and a second end portion that is in overlying relation with a second end portion of the base without extending beyond the second end portion of the base.

In aspects, the base may include one or more stabilizers configured to inhibit movement of the base relative to an underlying support surface.

In accordance with another aspect of the present disclosure, a paper towel roll holder includes a rod extending from a base so as to define a non-perpendicular angle therebetween. The rod may be configured to be at least partially inserted into a hollow bore of a paper towel roll. The paper towel roll holder has a center of gravity below the rod.

In aspects, a pump may be coupled to the rod and may be in fluid communication with a cleaning agent.

In aspects, an extended edge of the base may extend further than a top end of the rod.

In aspects, the base may define a first mass greater than a second mass of the rod such that the center of gravity is below the rod.

In accordance with yet another aspect of the present disclosure, a method of using a paper towel dispenser includes placing a paper towel roll onto a rod of the dispenser, such that a first end of the paper towel roll rests against a stopper and a second end is free and unencumbered. Next, an open edge of the paper towel roll is grasped along the second end of the paper tower roll, and pulled until at least one rectangle or square of the paper towel roll is fully unfurled and a perforated line of the at least one rectangle or square is taught. Then, the at least one rectangle or square is removed from the paper towel roll by tearing downward along the perforated line from the second end down to the first end. A soap pump may be affixed to the rod to provide a cleaning agent, such as hand soap or sanitizer, to the user.

BRIEF DESCRIPTION OF THE DRAWINGS

The accompanying drawings, which are incorporated in and constitute a part of this specification, illustrate aspects and features of the disclosure and, together with the detailed description below, serve to further explain the disclosure, in which.

DETAILED DESCRIPTION

Figure 1:
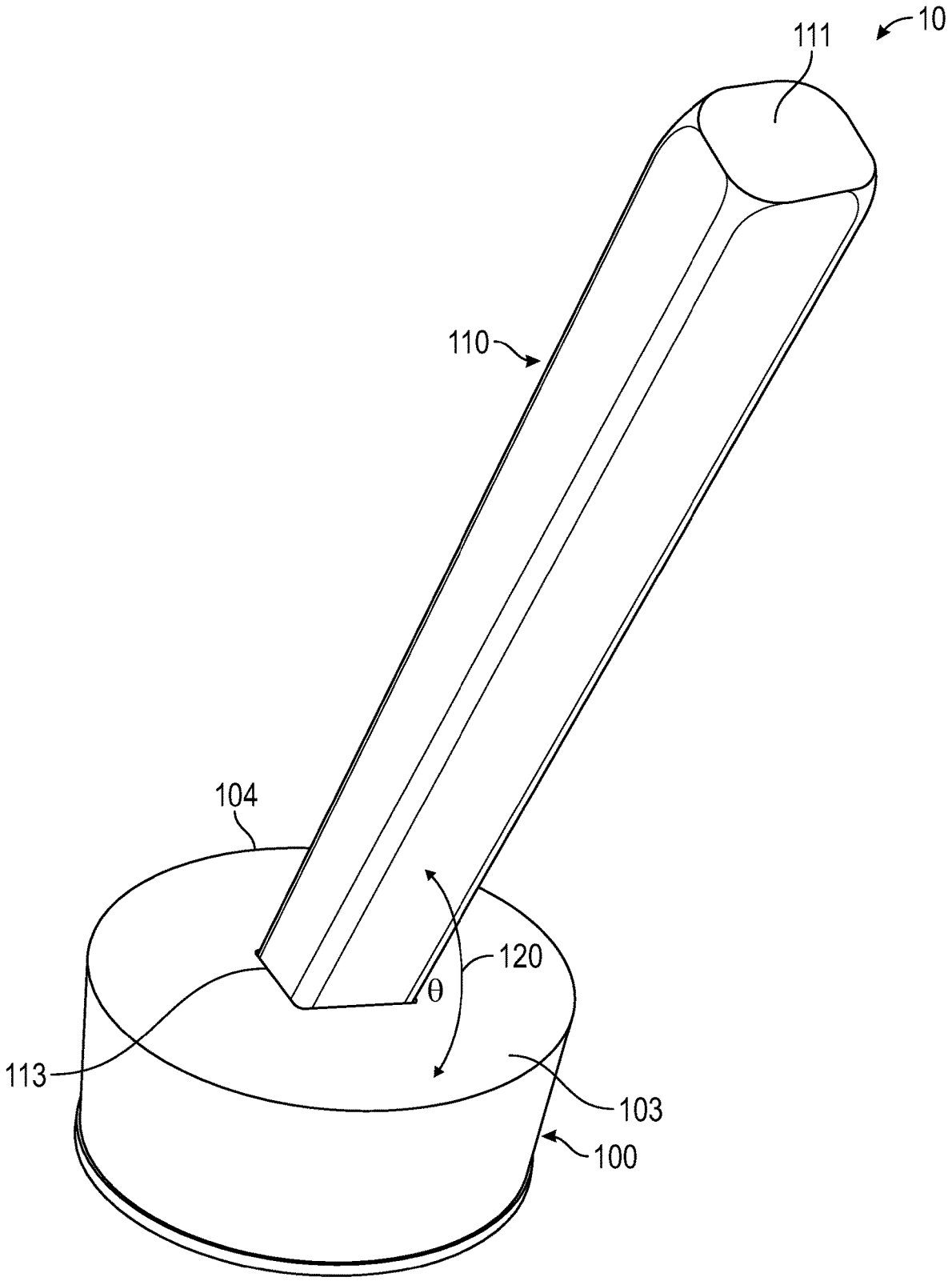
FIG. 1 is a perspective view of a free-standing paper towel dispenser provided in accordance with the present disclosure.
Figure 2:
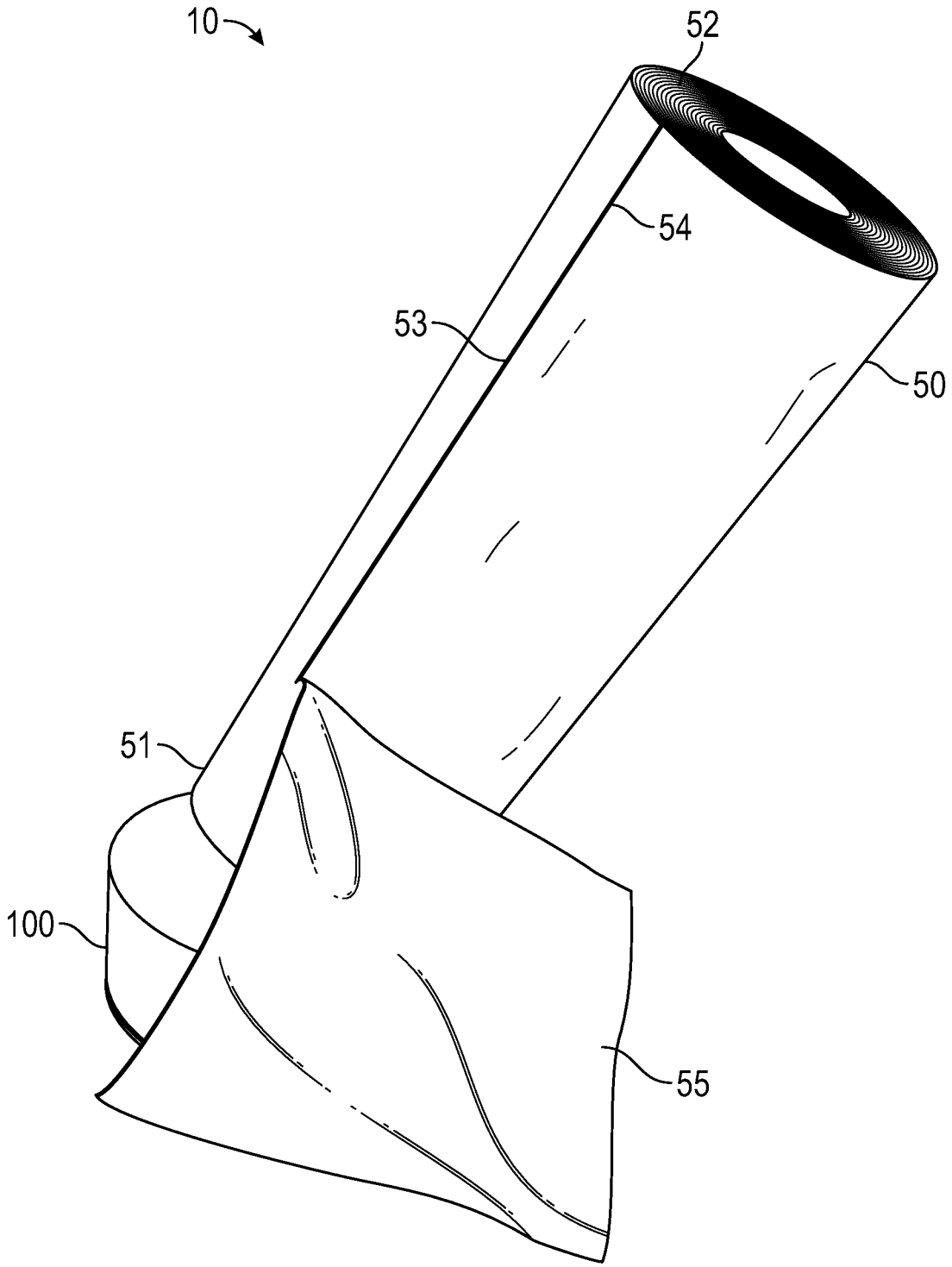
FIG. 2 is a perspective view of the free-standing paper towel dispenser shown in FIG. 1 in use with a paper towel roll.

Descriptions of technical features or aspects of an exemplary embodiment of the disclosure should typically be considered as available and applicable to other similar features or aspects in another exemplary embodiment of the disclosure. Accordingly, technical features described herein according to one exemplary embodiment of the disclosure may be applicable to other exemplary embodiments of the disclosure, and thus duplicative descriptions may be omitted herein.

Exemplary embodiments of the present disclosure will be described more fully below (e.g., with reference to the accompanying drawings). Like reference numerals may refer to like elements throughout the specification and drawings.

Terms including "generally," "about," "substantially," and the like, as utilized herein, are meant to encompass variations, e.g., manufacturing tolerances, material tolerances, use and environmental tolerances, measurement variations, and/or other variations, up to and including plus or minus 10 percent.

FIGS. 1-4 illustrate two aspects of a free-standing paper towel dispenser 10. Both aspects include a base 100 and an elongated rod 110 that extends upward from the base 100 at a non-perpendicular angle 120. The rod 110 is sized and proportioned to be at least partially inserted through the hollow center of a paper towel roll 50. To inhibit unwanted rotation of the paper towel roll 50, the cross-section of the rod 110 is non-circular, e.g. oval, polygonal, star-shaped, etc. The angle 120 at which the rod 110 extends relative to the base 100 is less than 90 degrees, such as, for example, from about 45 degrees to about 85 degrees, and preferably approximately 70 degrees. The slanted position and the non-circular shape of the rod 110 ensure that the paper towel roll 50 stays in position without unwanted rotation when a rectangle or square section 55 of the paper towel roll 50 is being removed. However, at this slanted angle 120, the base 100 and rod 110 combination naturally has a high center of gravity, which would make the dispenser 10 as a whole more prone to toppling. To counterbalance this toppling effect, the base 100 can be made from a dense/heavy material (e.g., marble, wood, a stainless steel slab), or have an additional weight embedded within to lower the center of gravity of the paper towel dispenser 10 as a whole. The base 100 may be configured such that the center of gravity of the paper towel dispenser 10 as a whole is below the rod 110 and/or within the base 100 at a location where the rod 110 connects to the base 100.

Figure 3:
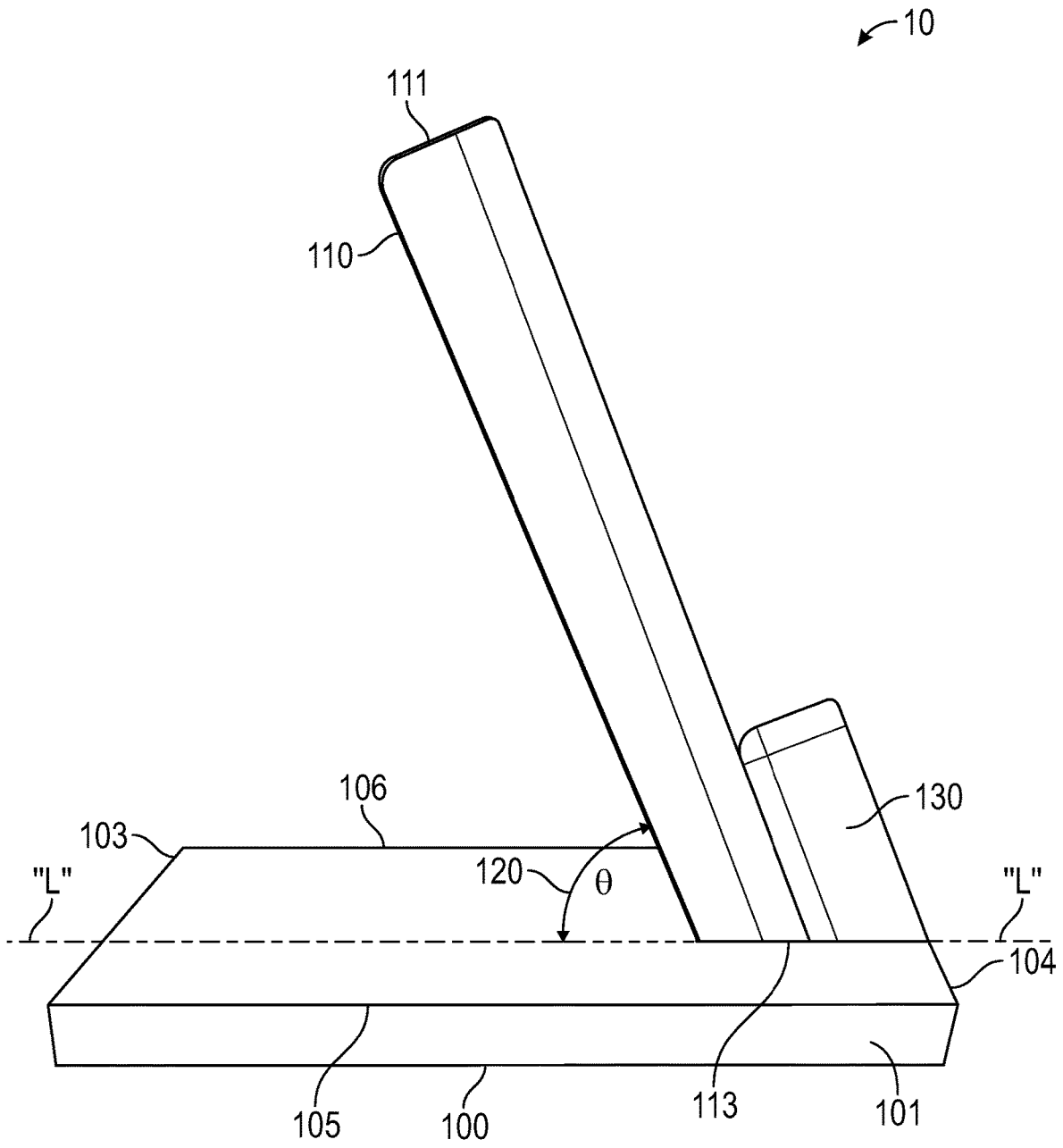
FIG. 3 is a side, perspective view of another configuration of a free-standing paper towel dispenser.

The base 100 may be cylindrical (FIG. 1) or prismatic (FIG. 3), or any other suitable shape. Where the paper towel dispenser 10 is prismatic, the base 100 has a left longitudinal edge 105 and a right longitudinal edge 106. The left and right longitudinal edges 105, 106, may be longer than the front and rear end portions 103, 104. The base 100 may be elongated such that a top end 111 of the rod 110 does not extend beyond a front end portion 103 of the base 100. The rod 110 includes a bottom end portion 113 that is coupled to the base 100. In aspects, the bottom end portion 113 of the rod 110 is connected to a rear end portion 104 of the base 100 along a central longitudinal axis "L" of the base 100 (as illustrated in FIG. 3) as opposed to a central region of the base 100 (as illustrated in FIG. 1). The bottom end portion 113 may be coupled to the base 100 via an adhesive, a mechanical retainer (e.g., a screw, fastener, pin, etc.), or may be integrally formed with the base 100. The base 100 and the rod 110 may be manufactured as a single structure or as separate structures and then permanently fixed to one another. For example, the base 100 and rod 110 may be cast together from a plastic mold or made of separate wood material and then fixed to one another.

Figure 4:
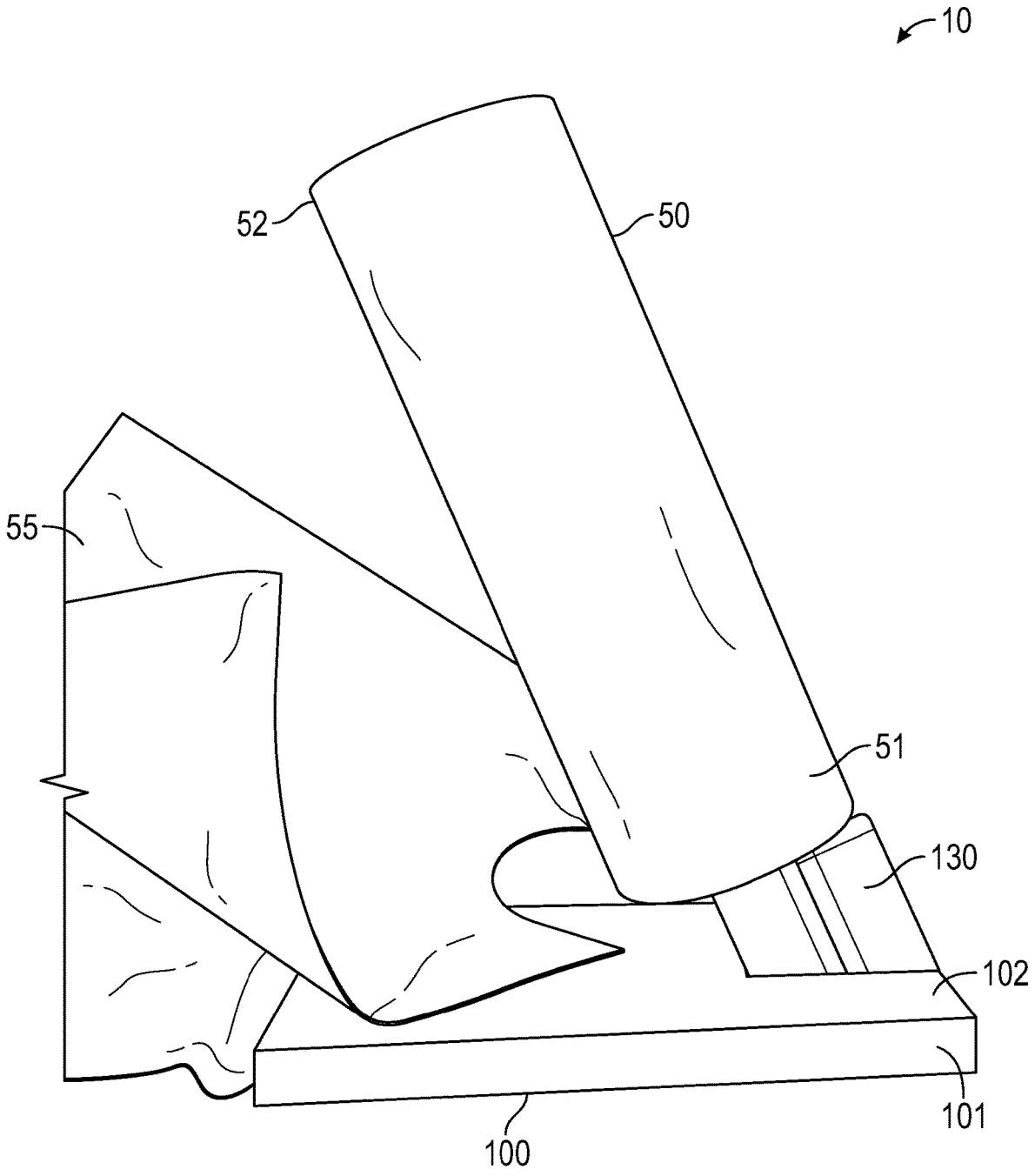
FIG. 4 is a side, perspective view of the free-standing paper towel dispenser shown in FIG. 3 in use with a paper towel roll.

In aspects, the paper towel dispenser 10 can also include a stopper 130, affixed to the base 100 adjacent to the rod 110, to prevent the paper towel roll 50 from resting directly against the base 100, as shown in FIG. 4. The stopper 130 creates a distance between the paper towel roll 50 and the surface supporting the base 100, and thereby prevents unwanted contamination of the paper towel roll 50 with any undesirable substances that may be present on the supporting surface. Additionally, the stopper 130 can act as a secondary counterweight to the paper towel roll 50 and can serve to reinforce the angled extension of the rod 110.

Figure 5:
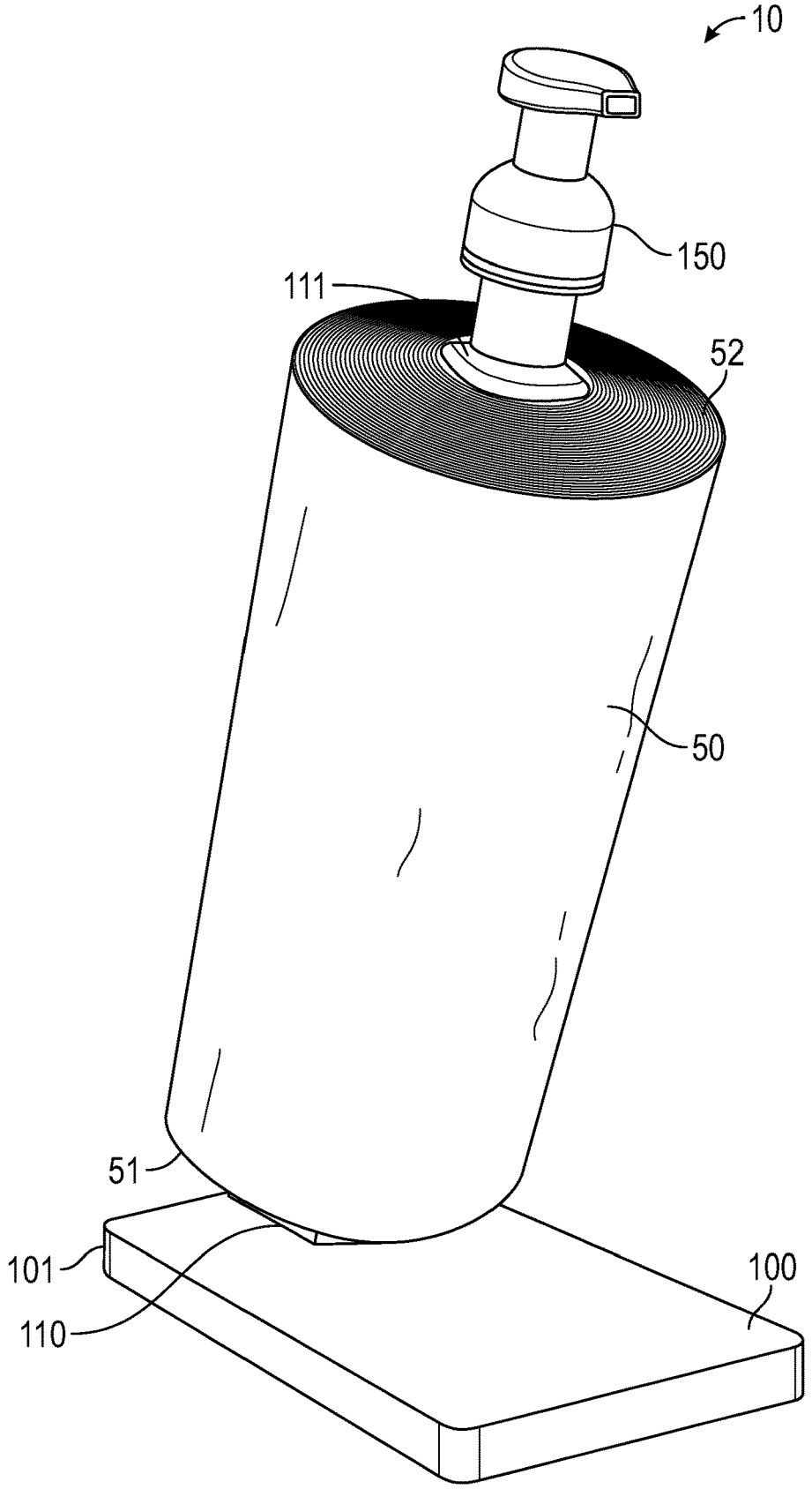
FIG. 5 is a perspective view of another configuration of a paper towel dispenser having a soap pump affixed thereto.
Figure 6:
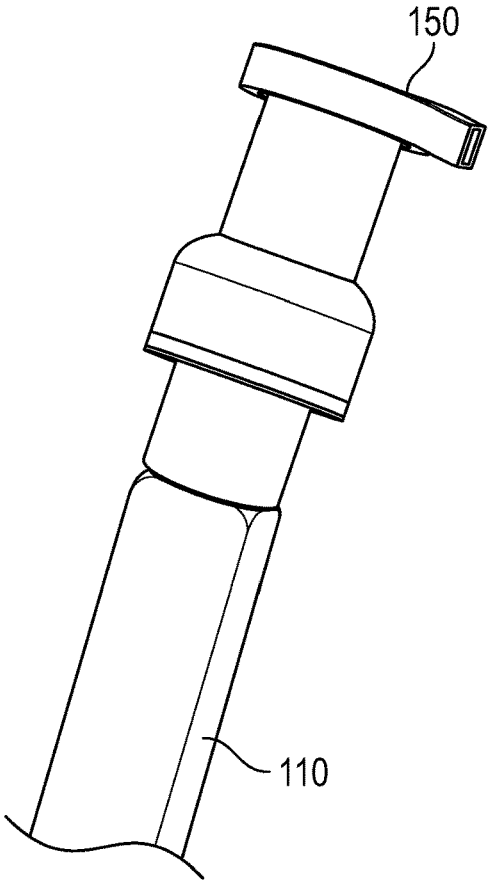
FIG. 6 is a close up view of the soap pump of the paper towel dispenser shown in FIG. 5.
Figure 7:
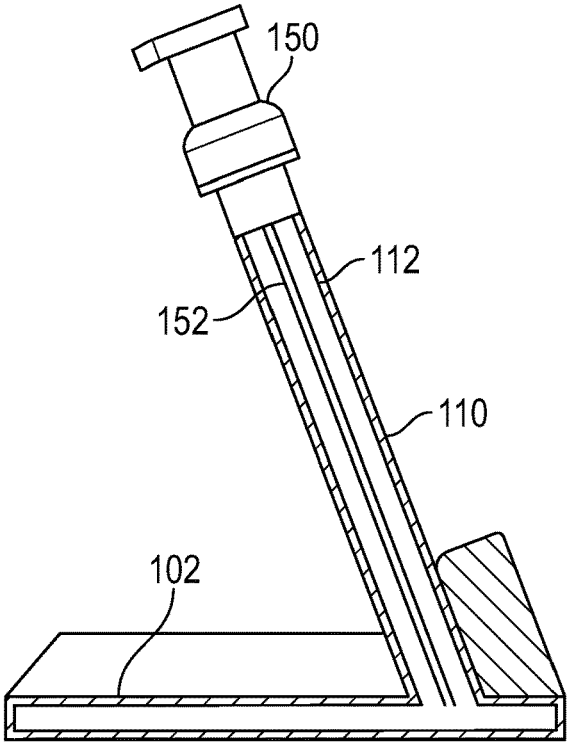
FIG. 7 is a side view illustrating a rod and base of the paper towel dispenser of FIG. 5 in cross-section with the soap pump affixed thereto and a tube extending through a bore of the rod of the free-standing paper towel dispenser.

In other aspects, the paper towel dispenser 10 can also include a soap pump 150 affixed to the top or free end 111 of the rod 110, as shown in FIGS. 5, 6, and 7. The soap pump 150 includes a tube 152 (FIG. 7) passing through a central bore 112 (FIG. 7) in the rod 110 that is coupled to a reusable container (not explicitly shown) externally located from the paper towel dispenser 10 such that the soap pump 150 can be repeatedly refilled with cleaning agents like soap or hand sanitizer. Alternatively, the rod 110 may have a central bore 112 that is filled with cleaning agents like liquid soap or hand sanitizer. In aspects, the base 100 may also include a chamber 102 (FIG. 7) in fluid communication with the tube 152 or central bore 112 of the rod 110 such that the paper towel dispenser 10 may contain an even larger volume of cleaning agents. Alternatively, or in addition to the above aspects, the stopper 130 may define a chamber for containing cleaning agents and is in fluid communication with the soap pump 150. In aspects, the cleaning agents may be added via a refill coverable opening (not shown) defined by the base 100 through which the cleaning agents may be supplied through. In other aspects, the soap pump 150 may be a screw-top soap pump that can be removed, and cleaning agents disposed through the central bore 112 of the rod 110 or through the tube 152 in the rod 110.

Figure 8:
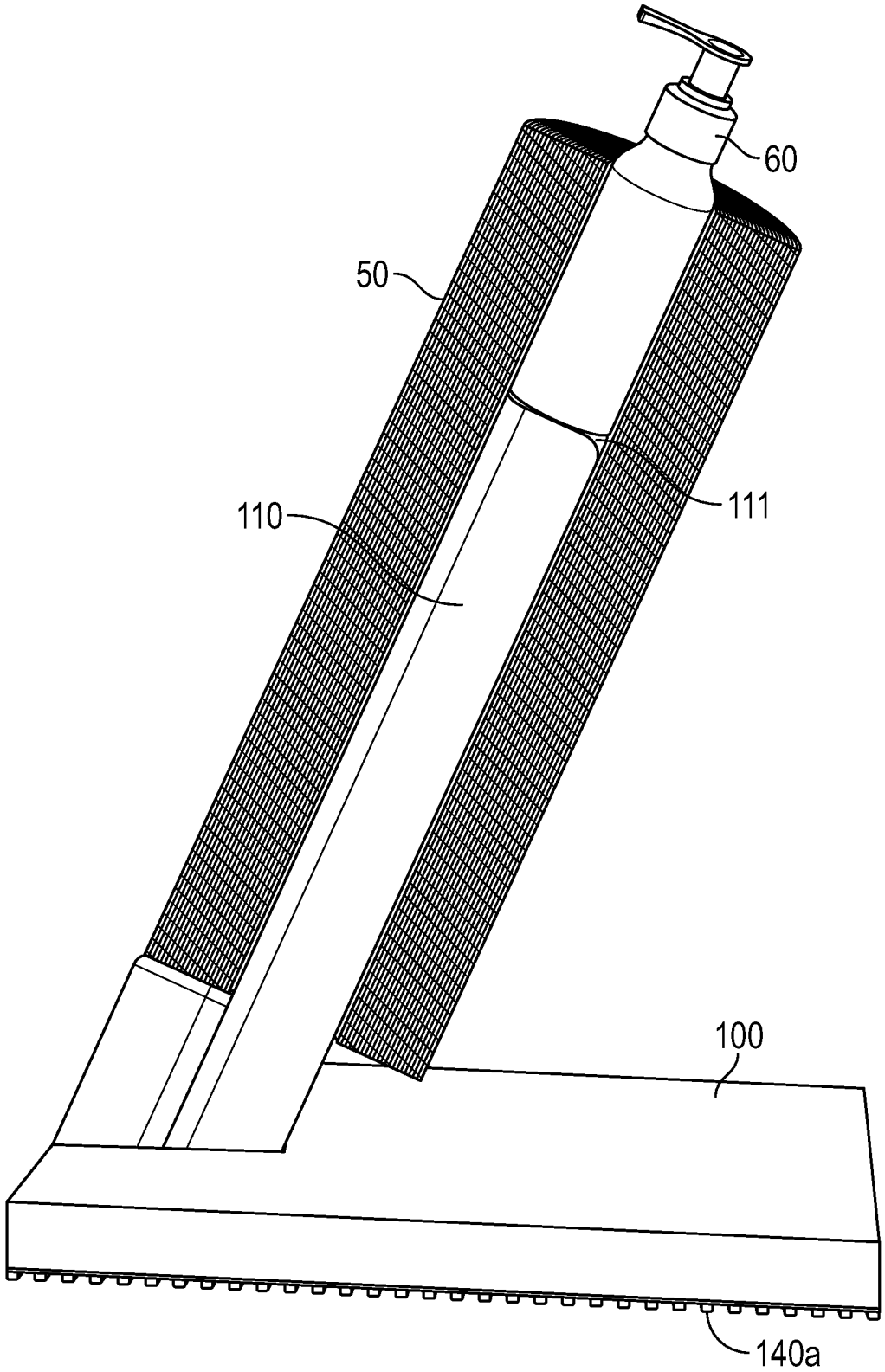
FIG. 8 is a side view of another configuration of a free standing paper towel dispenser, with a paper towel roll in cross section and a bottle of cleaning agent supported by the free standing paper towel dispenser.

With reference to FIG. 8, the rod 110 may have a length measured from the top or free end 111 of the rod 110 to the base 100 and along the longitudinal axis of the rod 110. The length of the rod 110 is configured such that the top or free end 111 does not extend past an open end of a standard-length paper towel roll 50. In aspects, the length of the rod 110 is configured to be smaller than a length of the paper towel roll 50 so as to define a gap between the free or top end 111 of the rod and the open end of the paper towel roll 50. The gap is configured to receive a bottle of cleaning agent 60 such that the bottom of the bottle of the cleaning agent 60 rests against the free or top end 111 of the rod 110. When the paper towel roll 50 is placed over the rod 110, the inside of the paper towel roll 50 secures the bottle of cleaning agent 60 and prevents the bottle of cleaning agent 60 from falling. The bottle 60 has an outer diameter substantially equal to an inner diameter of a core of the paper towel roll 50.

Figure 9:
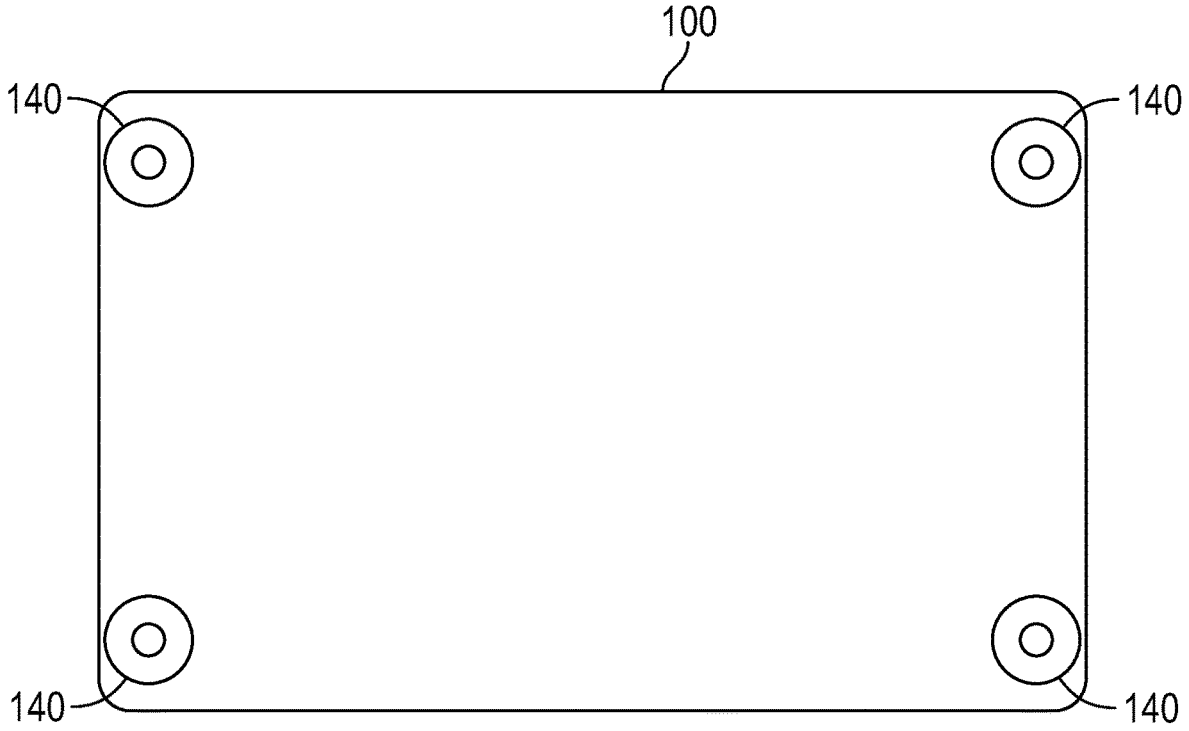
FIG. 9 is a bottom view of another configuration of a free-standing paper towel dispenser including suction cups.

With reference to FIG. 9, the base 100 of the paper towel dispenser 10 can also include one or more stabilizers 140 configured to inhibit movement of the base relative to an underlying support surface. The stabilizers 140 may be suction cups that serve to further secure the base 100 to the underlying supporting surface. The one or more suction cups 140 can either entirely replace the stability provided by the stopper 130 and any additional weight embedded within the base 100, or the one or more suction cups 140 can be used in addition to the stopper 130 and any additional weight embedded within the base 100 to increase the stability of the paper towel dispenser 10. In aspects, any similar stabilizer may be used instead of the suction cups 140, such as high friction rubber legs. In aspects, the stabilizer may be a sheet or block of rubber (140*a*, FIG. 8) or similar high-friction material disposed along at least a portion of the bottom of the base 100. The stabilizer is configured to inhibit the base 100 from moving when a rectangle or square section 55 of the paper towel roll 50 is being removed.

In use, the paper towel dispenser 10 provides for one-handed removal of individual squares or rectangles 55 from a paper towel roll 50. After placing the paper towel roll 50 onto a rod 110 of the paper towel dispenser 10, such that a first end 51 of the paper towel roll 50 rests against a stopper 130 and the second end 52 of the paper towel roll 50 is unencumbered, the user grasps an open edge 54 of the paper towel roll 50 along the second end 52 and pulls on the open edge 54 until at least one square 55 of the paper towel roll 50 is fully unfurled and a perforated line 53 of the at least one square 55 is taught. Then the user can tear downward along the perforated line 53 of the at least one square 55 from the second end 52 down to the first end 51 until the at least one square 55 is removed from the paper towel roll 50 without rotating the paper towel roll.

From the foregoing and with reference to the various figure drawings, those skilled in the art will appreciate that certain modifications can also be made to the disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A paper towel dispenser for use with a paper towel roll comprising:

a base; and a rod supported on the base, the rod extending upward from the base at a non-perpendicular angle, the rod defining a non-circular cross-section perpendicular to a longitudinal axis of the rod such that the rod is configured to inhibit rotation of the paper towel roll relative to the rod.

2. The paper towel dispenser from claim 1, wherein the base is weighted and configured to provide a counterweight to the paper towel roll.

3. The paper towel dispenser from claim 2, wherein the base is made from a dense material.

4. The paper towel dispenser from claim 2, wherein the base has a low center of gravity.

5. The paper towel dispenser from claim 1, wherein the non-perpendicular angle between the base and the rod is approximately 70 degrees.

6. The paper towel dispenser from claim 1, wherein the rod is configured to be at least partially inserted into the paper towel roll.

7. The paper towel dispenser from claim 1, further including a stopper affixed to the base adjacent and parallel to the rod, the stopper configured to prevent the paper towel roll from resting directly against the base.

8. The paper towel dispenser from claim 1, wherein the rod defines a length that is smaller than a length of a paper towel roll to define a gap between a top end of the rod and an open end of the paper towel roll when the rod is inserted into the paper towel roll, the gap configured to receive a bottle of cleaning agent.

9. The paper towel dispenser from claim 7, wherein the rod and stopper are positioned adjacent a rear edge of the base and along a central longitudinal axis of the base.

10. The paper towel dispenser from claim 1, wherein the base acts as a stopper configured to create a separation between the paper towel roll and a surface supporting the base.

11. The paper towel dispenser from claim 1, further including a soap pump affixed to a free end of the rod.

12. The paper towel dispenser from claim 11, wherein the rod includes a central bore configured to receive a tube that is coupled to the soap pump, the tube configured to convey soap from an external source for a cleaning agent.

13. The paper towel dispenser from claim 11, wherein the rod defines a central bore configured to directly store a cleaning agent, the central bore configured to be in fluid communication with the soap pump.

14. The paper towel dispenser from claim 1, further including one or more stabilizers configured to inhibit movement of the base relative to an underlying support surface.

15. A paper towel roll holder, comprising;

an elongated base having a rear end portion and a front end portion; and a rod extending from the rear end portion of the elongated base at a non-perpendicular angle relative to the elongated base such that a center of gravity of the paper towel roll holder is at the rear end portion of the elongated base, the rod defining a non-circular cross-section perpendicular to a longitudinal axis of the rod, wherein the rod is configured to be at least partially inserted into a hollow bore of a paper towel roll.

16. The paper towel roll holder of claim 15, further comprising a removable pump coupled to the rod, the removable pump being in fluid communication with a cleaning agent.

17. The paper towel roll holder of claim 15, wherein the front end portion of the elongated base has a front edge positioned beyond a top end of the rod.

18. The paper towel roll holder of claim 15, wherein the elongated base has a first mass that is greater than a second mass of the rod such that the center of gravity is below the rod.

19. The paper towel roll holder of claim 15, further comprising a stopper affixed to the elongated base adjacent to the rod, the stopper configured to prevent the paper towel roll from resting directly against the elongated base.

20. The paper towel dispenser from claim 1, wherein the non-perpendicular angle between the base and the rod is from about 45 degrees to about 85 degrees.

* * * * *